US009724558B2

(12) United States Patent
Chen

(10) Patent No.: US 9,724,558 B2
(45) Date of Patent: Aug. 8, 2017

(54) QUICK SLIDE HANDLE ASSEMBLY FOR CABLE EXERCISE EQUIPMENT

(71) Applicant: Jenkins Asia Tech (Shanghai) Limited, Shanghai (CN)

(72) Inventor: Weng Kin Chen, Shanghai (CN)

(73) Assignee: Jenkins Asia Tech (Shanghai) Limited, Shanghai (CN)

( * ) Notice: Subject to any disclaimer, the term of this patent is extended or adjusted under 35 U.S.C. 154(b) by 0 days.

(21) Appl. No.: 15/078,852

(22) Filed: Mar. 23, 2016

(65) Prior Publication Data

US 2016/0287926 A1 Oct. 6, 2016

(30) Foreign Application Priority Data

Mar. 30, 2015 (CN) ..... 2015 2 0184941

(51) Int. Cl.
*A63B 21/05* (2006.01)
*A63B 21/00* (2006.01)
*A63B 21/055* (2006.01)

(52) U.S. Cl.
CPC ..... *A63B 21/4033* (2015.10); *A63B 21/0557* (2013.01); *A63B 21/4035* (2015.10); *A63B 21/0552* (2013.01); *A63B 2209/02* (2013.01)

(58) Field of Classification Search
CPC ..... A63B 21/0004; A63B 21/00043; A63B 21/00058; A63B 21/00061; A63B 21/00065; A63B 21/00069; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/08; A63B 21/15; A63B 21/151; A63B 21/152; A63B 21/16; A63B 21/4023;

(Continued)

(56) References Cited

U.S. PATENT DOCUMENTS 3,528,656 A * 9/1970 Haanen ..... A63B 21/0004 24/605
5,885,196 A 3/1999 Gvoich (Continued)

*Primary Examiner* — Sundhara Ganesan
*Assistant Examiner* — Gary D Urbiel Goldner
(74) *Attorney, Agent, or Firm* — Levine Bagade Han LLP

(57) ABSTRACT

An exercise cable handle assembly is disclosed comprising a locking mechanism including a handle base and a flexible retaining clip. The handle base comprises a cable opening and two side clamps defining a locking channel. The two side clamps comprise gradated edges. The flexible retaining clip is U shaped and comprises at least one curved hook end configured to engage with the gradated edge when the flexible retaining clip is positioned in the locking channel. The exercise cable handle assembly further comprises a segment of an exercise cable comprising a tapered plug along the segment of cable and a handle frame coupled to the handle base. The locking mechanism secures the segment of the exercise cable to the handle base when a portion of the tapered plug is positioned in the cable opening and the flexible retaining clip partially surrounds the tapered plug when positioned in the locking channel.

8 Claims, 4 Drawing Sheets

(58) Field of Classification Search
CPC ..... A63B 21/4025; A63B 21/4033; A63B 21/4035; A63B 21/4039; A63B 21/4043; A63B 21/4045; A63B 23/12; A63B 23/1209; A63B 23/1245; A63B 23/1281; A63B 23/14; A63B 71/0054; A63B 2071/0063; A63B 2071/0072; A63B 2071/0081; A63B 2071/009; A63B 2209/02; A63B 2225/09; Y10T 24/47
See application file for complete search history.

(56) References Cited

U.S. PATENT DOCUMENTS 6,497,641 B1 12/2002 Hinds
6,692,415 B1 * 2/2004 Winston ..... A63B 21/0004 482/122
6,692,416 B1 2/2004 Davis
6,923,750 B1 * 8/2005 Hinds ..... A63B 21/00043 482/121
7,357,762 B1 * 4/2008 Terry ..... A63B 21/0552 482/121
8,782,854 B1 * 7/2014 Samuels ..... B25G 1/102 16/428
8,904,603 B1 * 12/2014 Samuels ..... A63B 21/0557 16/428
8,961,379 B2 * 2/2015 Flentye ..... A63B 21/0552 482/121
2005/0137066 A1 6/2005 Wu
2011/0098159 A1 * 4/2011 Wiseman ..... A63B 21/0552 482/108
2011/0312477 A1 * 12/2011 Wiseman ..... A63B 21/0442 482/126
2013/0288864 A1 * 10/2013 Holland ..... A63B 21/4023 482/126
2014/0066270 A1 * 3/2014 Lin ..... A63B 21/00065 482/121
2015/0366298 A1 * 12/2015 Blackman ..... A44B 11/005 431/253
2016/0067538 A1 * 3/2016 Friedberg ..... A63B 21/00061 482/126
2016/0199682 A1 * 7/2016 Borak ..... A63B 71/0054 482/126

* cited by examiner

QUICK SLIDE HANDLE ASSEMBLY FOR CABLE EXERCISE EQUIPMENT

CROSS-REFERENCE TO RELATED APPLICATIONS

The present application claims priority to Chinese Patent Application No. 201520184941.5 filed Mar. 30, 2015, which is herein incorporated by reference in its entirety.

FIELD OF TECHNOLOGY

The present disclosure relates generally to the field of exercising equipment for strengthening parts of the body, and, more specifically, to a handle assembly for fitness or training cables.

BACKGROUND

Training with cables, pulleys, and exercise equipment has become a common and popular training technique for fitness enthusiasts. Traditional training cables usually consist of a rope or band affixed to a handle by a multitude of connectors or buckles. Such traditional training cables are usually beset by several disadvantages or shortcomings including an abundance of superfluous and complex parts which increase the cost of such handles and makes disassembling such an apparatus challenging.

SUMMARY

A quick and easy to assemble exercise cable handle is disclosed. The exercise cable handle assembly can include a locking mechanism including a handle base and a flexible retaining clip. The handle base can include a cable opening and two side clamps defining a part of a locking channel. The exercise cable handle assembly can also include a handle frame coupled to the handle base.

Each of the two side clamps can comprise at least one gradated edge on one end of the side clamp. Each of the two side clamps can have a vertical wall and a horizontal overhang segment orthogonal to the vertical wall. The horizontal overhang segment can extend inwardly toward the center of the handle base and toward the cable opening. The horizontal overhang segments can prevent inadvertent vertical displacement of the flexible retaining clip out of the locking channel.

The flexible retaining clip can be substantially U shaped and can comprise at least one curved hook end configured to engage with the gradated edge of each of the two side clamps when the flexible retaining clip is positioned in the locking channel.

The exercise cable handle assembly can also include a segment of an exercise cable having a tapered plug along the exercise cable. The tapered plug can be made of rubber or synthetic rubber. The tapered plug, can also be made of or comprise a polymeric material, wood, metal, or a combination thereof. The locking mechanism can lock or secure the segment of the exercise cable to the remainder of the exercise cable handle assembly when the flexible retaining clip is positioned in the locking channel and partially surround the tapered plug of the exercise cable. The flexible retaining clip can partially surround the tapered plug when the tapered plug is positioned in the cable opening. The tapered plug can laterally expand the flexible retaining clip when the U shaped flexible retaining clip partially surrounds the tapered plug. The tapered plug can also apply a radially outward pressure to the flexible retaining clip and push the flexible retaining clip against the two side clamps. The U shaped flexible retaining clip can be quickly slid into the locking channel and can quickly and securely lock the segment of exercise cable to the handle base. The flexible retaining clip can also include a number of raised protrusions designed to indicate a pinch location along the flexible retaining clip.

The handle base can include a base body. The base body can include a pair of raised stoppers at each end of the base body. The base body can further have two retaining rods at each end of the base body. Each of the two retaining rods can be positioned in between the pair of raised stoppers. Each of the two retaining rods can also be separated from the base body by a space gap.

The handle frame can include two frame arms where each of the two frame arms has a folded end. The folded end of each of the two frame arms can define a folding loop or ring structure and the folded end of each of the two frame arms can loop or wrap around each of the two retaining rods to couple the handle frame to the handle base.

The handle frame can include a handle bar segment. The handle bar segment can be circumscribed, enveloped, or surrounded by a hollow tube. The hollow tube can serve as a gripping bar or rod for a user of the exercise cable handle assembly. The hollow tube can also be coated by a cushioning, material to provide comfort and cushioning for the user's hands.

DETAILED DESCRIPTION

Figure 1:
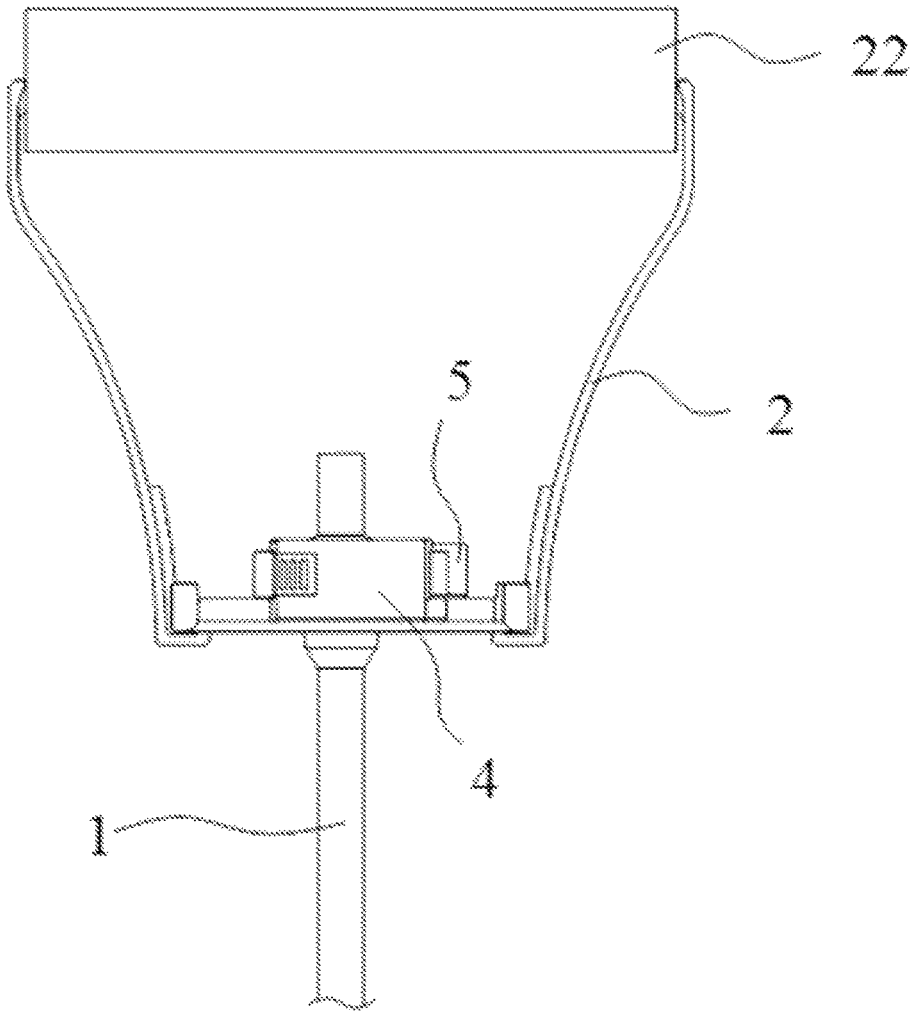
FIG. 1 illustrates a front view of an assembled exercise cable handle assembly.

FIG. 1 illustrates a front view of an exercise cable handle assembly in an assembled state. The exercise cable handle assembly can include a segment of an exercise cable 1, a handle frame 2, a handle base 4 including a flexible retaining clip 5, and a cushioning material 22 serving as a grip or cushioning layer for the handle frame 2.

The exercise cable 1 can be an elastic cable, a polymer-based cable, a metallic, cable such as a stainless steel cable, a fabric or cloth cable, or a combination thereof. In one embodiment, the exercise cable 1 can be a part of a cable cross over machine or tower. In other embodiments, the exercise cable 1 can be a cable connected to a weight training machine, a pulley device, or a combination thereof. In additional embodiments, the exercise cable 1 can be a portion of an exercise strap, resistance band, suspension cable, or a combination thereof.

In one embodiment, the handle frame 2 can be a stirrup shaped handle such as an upside down trapezoid having inwardly curving sides. In other embodiments, the handle frame 2 can be a substantially triangular or rectangular shaped handle. In one embodiment, the handle frame 2 can be made of or comprise a piece of shaped metal. In other embodiments, the handle frame 2 can be composed of or comprise a piece of molded plastic. In further embodiments, the handle frame 2 can be composed of or comprise wood.

The handle base 4 can be coupled to the handle frame 2. The coupling of the handle base 4 with the handle frame 2 will be discussed in more detail below. The handle base 4 can be composed of or comprise a polymer, a metal, or a combination thereof. In one embodiment, the handle base 4 can be a single piece of injection molded plastic. In this and other embodiments, the handle base 4 can be made of ABS plastic, polypropylene, polylactic acid, polycarbonate, or a combination thereof.

The handle base 4 can removeably couple to the flexible retaining clip 5 to secure or lock the exercise cable 1 to the handle frame 2 and the rest of the exercise cable handle assembly.

Figure 2:
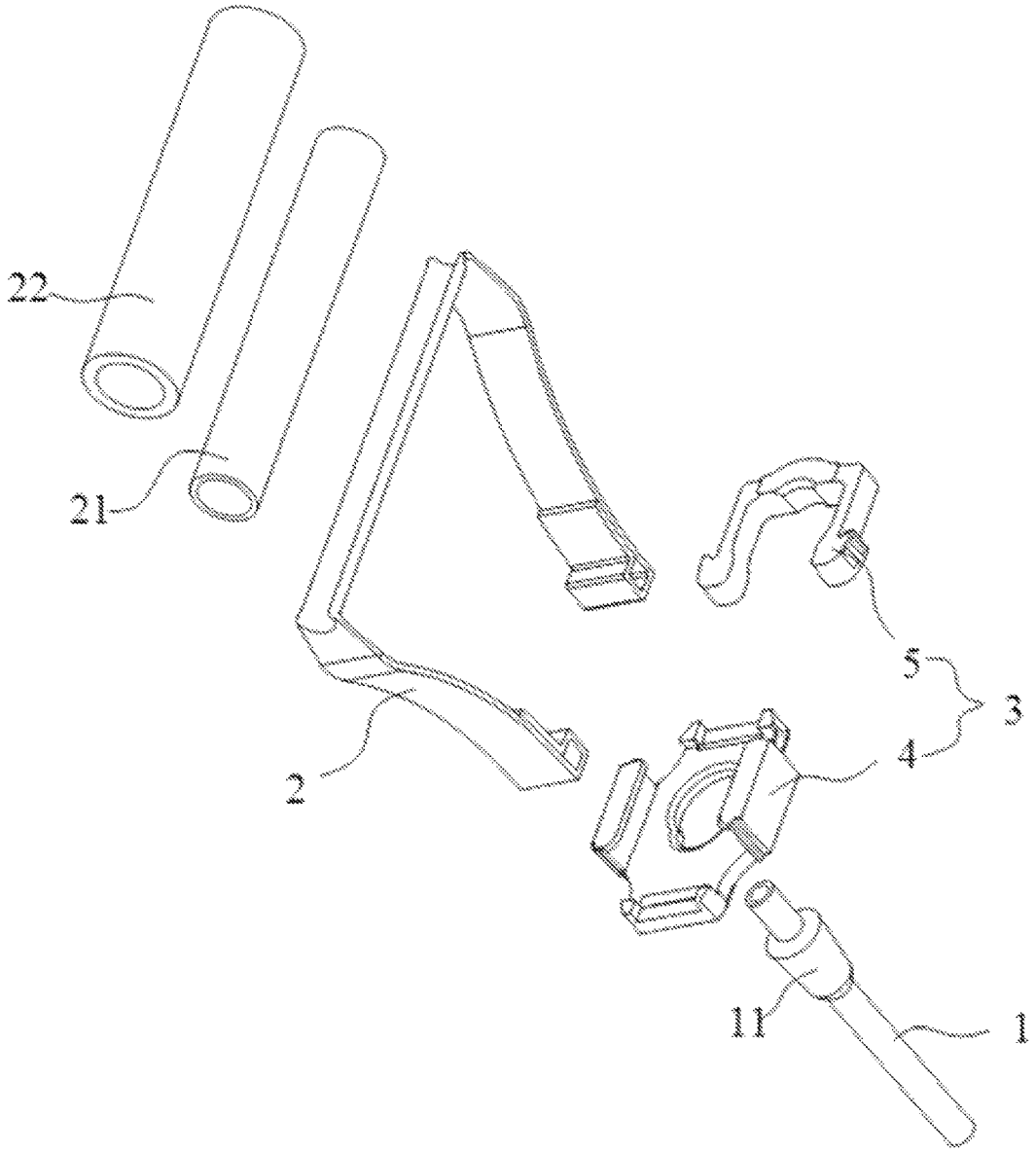
FIG. 2 illustrates an exploded view of the exercise cable handle assembly.

FIG. 2 illustrates an exploded view of the exercise cable handle assembly. FIG. 2 illustrates that the exercise cable handle assembly can have a locking mechanism 3. The locking mechanism 3 can include the handle base 4 and the flexible retaining clip 5. As shown in FIG. 2, the handle base 4 can include a cable opening 44 (see FIG. 3) and two side clamps 42 (see FIG. 3).

FIG. 2 illustrates that the exercise cable 1 can have a tapered plug 11 along a segment of the exercise cable 1. In the embodiment shown in FIG. 2, the tapered plug 11 can be substantially frustoconical in shape. In other embodiments, the tapered plug 11 can be substantially conical or funnel shaped.

The tapered plug 11 can be made of rubber or synthetic rubber. The tapered plug 11 can also be made of a soft thermoplastic. For example, the tapered plug 11 can be made of a polymer having a Shore D Hardness below 80. The tapered plug can also be made of or comprise wood, metal, fabric, or a combination thereof.

For example, the tapered plug 11 can be a frustoconical shaped piece of rubber or hard foam affixed to the exercise cable 1 via adhesives, clips, interference fit, or a combination thereof. In other embodiments, the tapered plug 11 can be a shaped piece of wood, a tangle of fabric, a metal bulb, or a combination thereof. The tapered plug 11 can be a bulbous shaped construct having a progressively diminished radial diameter toward the proximal end of the exercise cable 1. In this embodiment, the largest radial diameter of the tapered plug 11 is at the distal end of the exercise cable 1.

The handle frame 2 can include two frame arms. The two frame arms can be the two sides of the stirrup shaped handle frame 2. Each of the two frame arms can have a folded end. The folded end can be a terminal segment of the frame arm that folds back on to the frame arm. In the embodiment shown in FIG. 2, the terminal segment of each frame arm can fold back on to the frame arm to create or define a folding loop or folding, channel structure. As will be discussed in the following sections, the folding loop or folding channel structure can allow the handle frame 2 to couple or connect to the handle base 4.

The handle frame 2 can also include a handle bar segment connecting the two frame arms. In one embodiment, the handle bar segment can have a trough, a depression, or a groove which receives a hollow tube 21. The hollow tube 21 can serve as a gripping bar or rod for a user grasping on to the handle frame 2. In this embodiment, a cushioning material 22 can completely surround or wrap around both the handle bar segment and the hollow tube 21 once the hollow tube 21 is placed inside the trough, depression, or groove of the handle bar segment. The cushioning material 22 can provide comfort and cushioning for the user's hands as the user grasps the handle frame 2.

In other embodiments, the handle bar segment can be circumscribed, enveloped, or surrounded by the hollow tube 21 first and then surrounded by the cushioning material 22. In some embodiments, the cushioning material 22 can be made of or comprise a polymer foam, polyurethane, rubber, synthetic rubber, or a combination thereof in other embodiments, the cushioning material 22 can be a foam coating.

Figure 3:
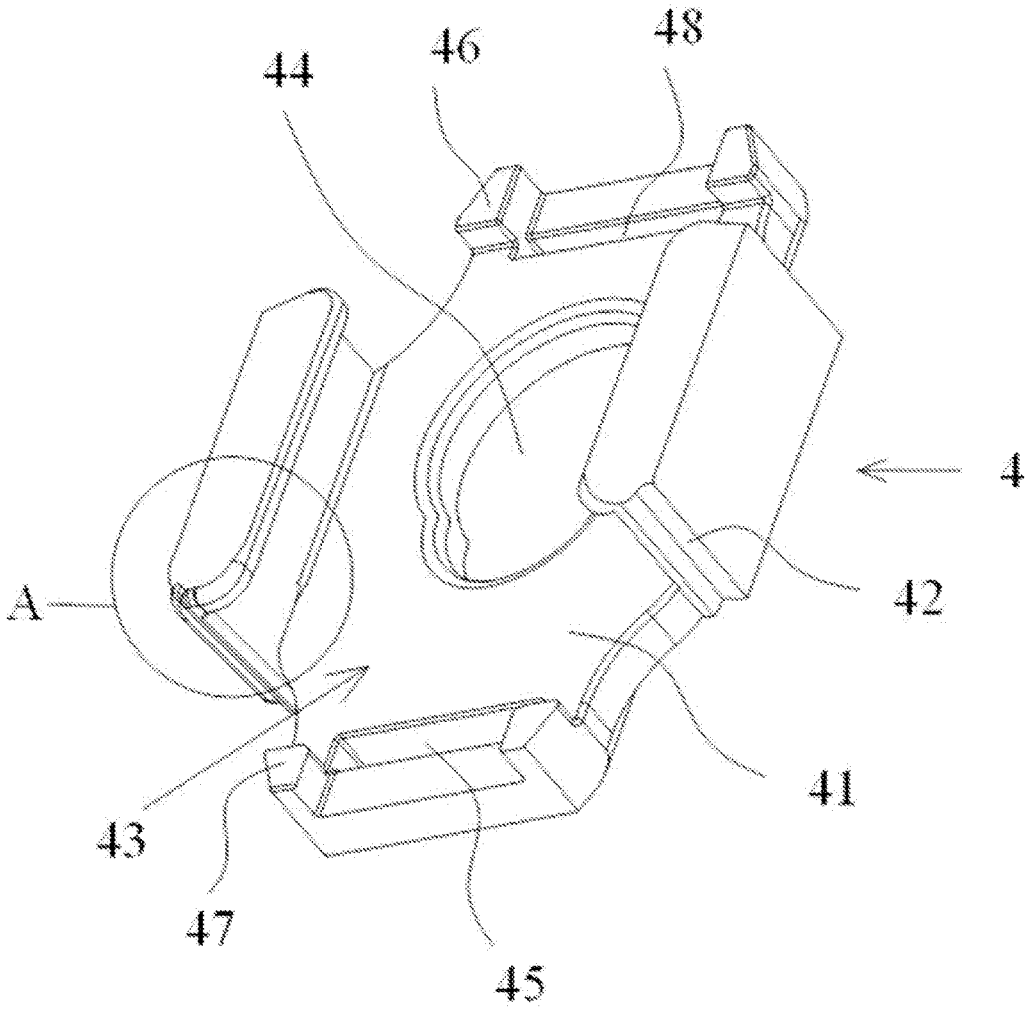
FIG. 3 illustrates a handle base of the exercise cable handle assembly.

FIG. 3 illustrates that the handle base 4 of the exercise cable handle assembly can include a base body 41. The base body 41 can be substantially flat and have a slight thickness or depth dimension. In one embodiment, the base body 41 can be shaped generally as an octagon. In other embodiments, the base body 41 can be shaped generally as a rectangle, a hexagon, a decagon, or a pentagon. As depicted in FIG. 3, the base body 41 can be coupled or connected to two side clamps 42 defining a portion of a locking channel 43. Each of the two side clamps 42 can have a vertical, wall 421 (sec FIG. 4) and a horizontal overhang segment 422 (see FIG. 4). The horizontal overhang segment 422 can be orthogonal to the vertical wall 421 and be substantially parallel to the base body 41. Each of the two horizontal overhang segments 422 can extend inward toward the other horizontal overhang segment 422 and the cable opening 44.

The base body 41 can also comprise a first pair of raised stoppers 46 at one end of the base body 41 and a second pair of raised stoppers 47 at the other end of the base body 41. The first pair of raised stoppers 46 and the second pair raised stoppers 47 can refer to raised or elevated structures protruding or extending orthogonally from the base body 41. For example, the first pair of raised stoppers 46 and the second pair raised stoppers 47 can be shaped as three-dimensional polygons protruding or extending orthogonally from the base body 41. The first pair of raised stoppers 46 and the second pair raised stoppers 47 can extend or protrude beyond the plane of the base body 4 but not exceed the height of the vertical wall 421 of the side clamps 42.

The first pair of raised stoppers 46 can be connected by a first retaining rod. The first retaining rod can be separated from the base body 41 by a first space gap 48. The first space gap 48 can be a cutout or bore made through the base body 41. The first retaining rod can be shaped as a cylinder, a rectangular block, a triangular prism, or a combination thereof. The second pair of raised stoppers 47 can be connected by a second retaining rod. The second retaining rod can be separated from the base body 41 by a second space gap 45. The second space gap 45 can be a cutout or bore made through the base body 41. The second retaining rod can be shaped as a cylinder, a rectangular block, a triangular prism, or a combination thereof.

The handle frame 2 can couple to the handle base 4 when one of the folded ends of the handle arms folds around the first retaining rod and the other folded end of the other handle arm folds around the second retaining rod. In this embodiment, the first retaining rod is positioned inside the folding loop or the ring structure created by the folded end of one of the handle arms and the second retaining rod is positioned inside the folding loop or folding channel created by the folded end of the other handle arm. In these and other embodiments, the terminal end of one of the handle arms can be thread through the first space gap 48 and the terminal end of the other handle arm can be thread through the second space gap 45.

The two side clamps 42, the first raised stoppers 46, and the second raised stoppers 47 can define a locking channel 43. The locking, channel 43 can be a conduit or space designed to house or to hold the flexible retaining clip 5. The two side clamps 42, the first raised stoppers 46, and the second raised stoppers 47 can define the locking channel 43 by serving as boundaries or bumpers for the locking channel 43.

The flexible retaining clip 5 can removeably slide in and out of the locking channel 43. The vertical wall 421 can prevent the inadvertent lateral displacement or movement of the flexible retaining clip 5 out of the locking channel 43 and the first pair of raised stoppers 46 and the second pair of raised stoppers 47 can prevent the inadvertent longitudinal displacement or movement of the flexible retaining clip 5 out of the locking channel 43. In addition, the horizontal overhang segments 422 can prevent the inadvertent vertical displacement or movement of the flexible retaining clip out of the locking channel.

The base body 41 can have a cable opening 44 defined along a portion of the base body 41. The cable opening 44 can be a cutout or bore located substantially in the center of the base body 41. The cable opening 44 can be sized to allow the tapered plug 11 to fit through a section of the cable opening 44. For example, the cable opening 44 can be shaped as two overlapping circles or ovals. In this embodiment, one of the circles or ovals can be larger than the other circle or oval so as to allow the tapered plug 11 to fit through the larger circle or oval when the tapered plug 11 and exercise cable 1 is not secured by the locking mechanism 3. The smaller circle or oval can be sized to prevent or impede the tapered plug 11 from being longitudinally displaced through the cable opening 44 once the tapered plug 11 has entered the locking channel 43 through the larger circle or oval.

In the embodiment shown in FIG. 3, the cable opening 44 can be a conduit or channel having a channel depth or channel length equivalent to a thickness of the base body 41, in this embodiment, the conduit or channel can be consistent in size throughout the length of the conduit or channel. In other embodiments, the size of the conduit or channel can become progressively smaller as the conduit or channel approaches the bottom of the base body 41. In this embodiment, the bottom of the base body 41 can be the side of the base body 41 not facing the handle frame 2.

The handle base 4 can be manufactured front one piece of molded hard plastic. In other embodiments, the handle base 4 can be assembled from separate components.

Figure 4:
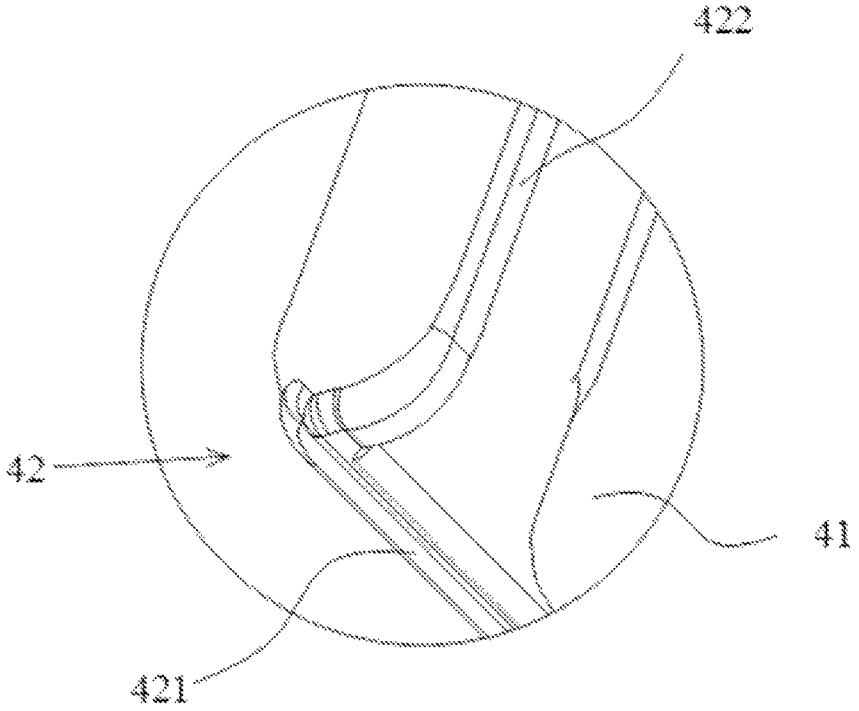
FIG. 4 illustrates a close up view of a portion of a side clamp of the handle base of FIG. 3.

FIG. 4 illustrates a close up view of a portion of the side clamp 42 highlighted by inset A of FIG. 3. FIG. 4 illustrates that the side clamps 42 can have a gradated edge at one end of each of the side clamps 42. The gradated edge can be an additional vertical segment of the side clamp 42 which is positioned laterally inward front the vertical wall 42. As depicted in FIG. 4, the gradated edge can be a step-like or multi-tiered structure at one end of the side clamp 42. As will be discussed in more detail below, a curved hook end of the flexible retaining clip 5 can engage with the gradated edge to retain or secure the flexible retaining clip 5 in the locking channel 43.

Figure 5:
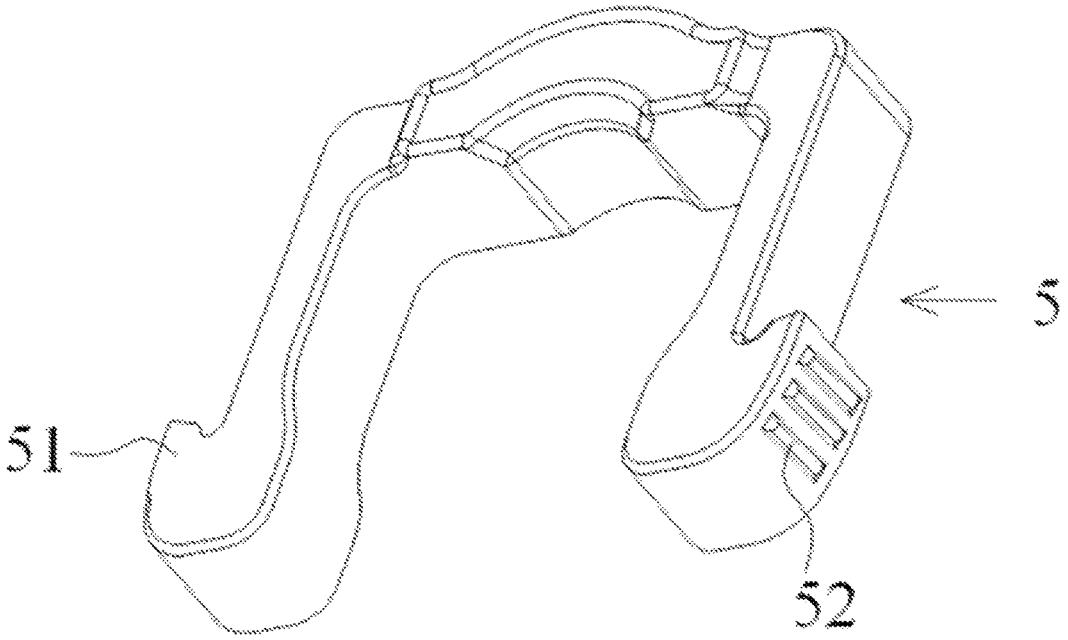
FIG. 5 illustrates a flexible retaining clip of the exercise cable handle assembly.

FIG. 5 illustrates that the flexible retaining clip 5 can be substantially U-shaped or shaped as a horseshoe. The flexible retaining dip 5 can comprise a dip head and two clip legs. The flexible retaining clip 5 can be composed of or comprise a polymer, a metal, or a combination thereof. In one embodiment, the flexible retaining clip 5 can be a single piece of injection molded plastic. In this and other embodiments, the flexible retaining clip 5 can be made of ABS plastic, polypropylene, polylactic acid, polycarbonate, or a combination thereof.

The clip legs can each be defined by a terminal end having a curved hook end. The curved hook end of the flexible retaining dip 5 refers to a portion of the clip legs which curve outwardly and back toward the clip head of the flexible retaining clip 5. When a terminal end of the clip leg, curves back toward the clip head, a half cylindrical divot or recess is formed which faces the clip head. The terminal end of each of the two clip legs can point in the direction of the clip head due to the curvature of the clip legs.

The curved hook end of the clip legs can engage with the gradated edge of the two side clamps 42 when the flexible retaining clip 5 is positioned in the locking channel 43. The curved hook end can be engaged with the gradated edge when the divot or recess, such as the cylindrical divot, formed by the outward curvature of the clip legs partially surrounds or envelops the gradated edge of one of the side clamps 42.

The segment of exercise cable 1 can be coupled to the handle base 4 when the terminal end of the tapered plug 11 is guided through the cable opening 44 and a portion of the tapered plug 11 resides in the locking channel 43. When a portion of the tapered plug 11 is located in the locking channel 43, the flexible retaining clip 5 can be slid into the locking channel 43 until the clip legs of the flexible retaining clip 5 partially surround the tapered plug 11. The tapered plug 11 can laterally expand the flexible retaining clip 5 when the flexible retaining clip 5 partially surrounds the tapered plug 11. The tapered plug 11 can also apply a radially outward pressure to the flexible retaining clip 5 and push the flexible retaining clip 5 against the two side clamps 52 of the handle base 4. The flexible retaining clip 5 can be secured in the locking channel 43 when the two curved hook ends of the clip legs engage with the two gradated edges of the side clamps 42.

The vertical walls 421 of the side clamps 42 can prevent lateral displacement or movement of the flexible retaining clip 5 out of the locking channel 43 and the horizontal overhang segments 422 can prevent the vertical displacement or movement of the flexible retaining clip 5 out of the locking channel 43 once the flexible retaining clip 5 secures the tapered plug 11 in the locking channel 43. The first pair of raised stoppers 46 and the second pair of raised stoppers 47 can also prevent the longitudinal displacement or movement of the flexible retaining clip 5 out of the locking channel 43 once the flexible retaining clip 5 secures the tapered plug 11 in the locking channel 43.

The flexible retaining clip 5 can also comprise a number of raised protrusions 52 used to indicate a pinch location along the clip legs of the flexible retaining clip 5. The raised protrusions 52 can also aid a user in pinching the clip legs of the flexible retaining clip 5 toward one another. For example, a user intending to remove or slide the flexible retaining clip 5 out of the locking channel 43 can pinch the clip legs at the raised protrusions 52 to dislodge or displace the flexible retaining clip 5 from the locking channel 43. The user can disassemble the exercise cable handle assembly by first pinching or applying inward pressure at or near the raised protrusions 52 of the flexible retaining clip 5. The user can then guide the flexible retaining clip 5 out of the locking channel 43 and retrieve the tapered plug 11 out of the cable opening 44. The user can then uncouple the handle frame 2 from the handle base 4.

One benefit provided by the separate handle base 4 and flexible retaining dip 5 of the exercise cable handle assembly is the speed with which a user can firmly and steadily secure an exercise cable 1 to a handle base 4 by inserting the tapered plug 11 through the cable opening 11 and clipping the tapered plug 11 with the flexible retaining clip 5.

Another advantage of the present exercise cable handle assembly is the design of the handle base 4 which allows a user to quickly slide the flexible retaining clip 5 in and out of the locking channel 43 but prevents inadvertent displacement or movement of the flexible retaining clip 5 out of the locking channel 43.

A number of embodiments have been described. Nevertheless, it will be understood by one of ordinary skill in the art that various changes and modifications can be made to this disclosure without departing from the spirit and scope of the embodiments. Elements of systems, devices and methods shown with any embodiment are exemplary for the specific embodiment and can be used in combination or otherwise on other embodiments within this disclosure. Accordingly, other embodiments are within the scope of the following, claims and the specification and/or drawings may be regarded in an illustrative rather than a restrictive sense.

I claim:

1. An exercise cable handle assembly comprising:

a locking mechanism comprising a handle base and a flexible retaining clip, wherein the handle base comprises a cable opening and two side clamps defining a part of a locking channel, wherein each of the two side clamps comprises a gradated edge on one end of each of the two side clamps, wherein the flexible retaining clip is U shaped and comprises at least one curved hook end configured to engage with the gradated edge when the flexible retaining clip is positioned in the locking channel;

a segment of an exercise cable comprising a tapered plug along the segment, wherein a portion of the tapered plug is positioned in the cable opening; and a handle frame coupled to the handle base, wherein the flexible retaining clip is positioned in the locking channel and partially surrounds the tapered plug to couple the segment of the exercise cable to the handle base, wherein the handle base further comprises a base body and the base body comprises two raised stoppers at each of two ends of the base body.

2. The exercise cable handle assembly of claim 1, wherein each of the two side clamps comprises a vertical wall and a horizontal overhang segment orthogonal to the vertical wall and extending inwardly toward a center of the handle base, and wherein the horizontal overhang segment is configured to prevent vertical displacement of the flexible retaining clip out of the locking channel.

3. The exercise cable handle assembly of claim 1, wherein the locking mechanism locks the segment of the exercise cable when the portion of the tapered plug partially surrounded by the U shaped flexible retaining clip laterally expands the flexible retaining clip and the flexible retaining clip pushes against the two side clamps.

4. The exercise cable handle assembly of claim 1, wherein the base body further comprises one retaining rod at each of the two ends of the base body and the respective one of the two retaining rods is positioned in between the respective two raised stoppers, wherein the respective one of the two retaining rods is separated from the base body by a space gap, wherein the handle frame further comprises two frame arms and each of the two frame arms comprises a folded end, and wherein the folded end of each of the two frame arms is looped around the respective one of the two retaining rods to couple the handle frame to the handle base.

5. The exercise cable handle assembly of claim 1, further comprising a hollow tube and wherein the handle frame further comprises a handle bar segment and wherein the hollow tube is coupled to the handle bar segment.

6. The exercise cable handle assembly of claim 5, wherein the hollow tube is coated by a cushioning material.

7. The exercise cable handle assembly of claim 1, wherein the U shaped flexible retaining clip further comprises at least one raised protrusion configured to indicate a pinch location along the flexible retaining clip.

8. The exercise cable handle assembly of claim 1, wherein the tapered plug comprises rubber.

* * * * *